US009039050B2

(12) United States Patent
Müller et al.

(10) Patent No.: US 9,039,050 B2
(45) Date of Patent: May 26, 2015

(54) DEVICE FOR ACTUATING THE CLOSURE OF A MOVABLE PART

(75) Inventors: Dirk Müller, Essen (DE); Ralf Lennhoff, Hagen (DE)

(73) Assignee: HUF NORTH AMERICA AUTOMOTIVE PARTS MANUFACTURING CORP., Milwaukee, WI (US)

( * ) Notice: Subject to any disclaimer, the term of this patent is extended or adjusted under 35 U.S.C. 154(b) by 570 days.

(21) Appl. No.: 12/663,831

(22) PCT Filed: May 30, 2008

(86) PCT No.: PCT/EP2008/056701

§ 371 (c)(1), (2), (4) Date: Dec. 9, 2009

(87) PCT Pub. No.: WO2008/151949

PCT Pub. Date: Dec. 18, 2008

(65) Prior Publication Data

US 2010/0171328 A1 Jul. 8, 2010

(30) Foreign Application Priority Data

Jun. 13, 2007 (DE) ..... 10 2007 027 845

(51) Int. Cl.

| | |
|---|---|
| ***E05B 3/00*** | (2006.01) |
| ***E05B 85/16*** | (2014.01) |
| *E05B 77/06* | (2014.01) |
| *E05B 79/06* | (2014.01) |

(52) U.S. Cl.

CPC ..... *E05B 85/16* (2013.01); *E05B 77/06* (2013.01); *E05B 79/06* (2013.01); *Y10S 292/30* (2013.01)

(58) Field of Classification Search

USPC ..... 292/336.3, 143, DIG. 23, DIG. 30

See application file for complete search history.

(56) References Cited

U.S. PATENT DOCUMENTS

| | | | | |
|---|---|---|---|---|
| 3,159,415 | A * | 12/1964 | Sandor | 292/336.3 |
| 4,066,857 | A * | 1/1978 | Suska | 200/61.7 |
| 4,482,179 | A * | 11/1984 | Johnson | 292/336.3 |

(Continued)

FOREIGN PATENT DOCUMENTS

| | | |
|---|---|---|
| DE | 19508518 | 9/1996 |
| DE | 19813316 | 10/1999 |

(Continued)

OTHER PUBLICATIONS

International Search Report; PCT/EP2008/056701; Nov. 17, 2008.

*Primary Examiner* — Kristina Fulton
*Assistant Examiner* — Faria Ahmad
(74) *Attorney, Agent, or Firm* — Cantor Colburn LLP

(57) ABSTRACT

The invention relates to a device (10) for actuating the closure of a movable part (12) of a motor vehicle, in particular a door, or hatchback, or similar, comprising a support (11) that can be fixed to the inner face of the movable part (12), a bearing unit (20) that can be pivoted about a first axis (13) provided on the support (11) and a handle element (40) with a first (41) and a second end (42), the second end (42) being fixed to the bearing unit (20), whereby the handle element (40) can be pivoted together with the bearing unit (20). According to the invention, the first end (41) is pivotally mounted on the first axis (13) and at least one bearing element (22, 22*a*, 22*b*) is provided for the horizontal bearing of the first end (41), said bearing element being located in the region of the first axis (13).

15 Claims, 3 Drawing Sheets

(56) References Cited

U.S. PATENT DOCUMENTS

| | | | | |
|---|---|---|---|---|
| 4,813,723 | A * | 3/1989 | Anderson et al. | 292/336.3 |
| 5,123,687 | A * | 6/1992 | Pfeiffer et al. | 292/336.3 |
| 5,860,684 | A * | 1/1999 | Mizuki | 292/336.3 |
| 5,887,918 | A * | 3/1999 | Okada et al. | 292/336.3 |
| 5,975,597 | A * | 11/1999 | Makiuchi et al. | 292/336.3 |
| 6,007,122 | A * | 12/1999 | Linder et al. | 292/336.3 |
| 6,182,483 | B1 * | 2/2001 | von Kathen et al. | 70/208 |
| 6,234,041 | B1 * | 5/2001 | Larabet et al. | 74/523 |
| 6,447,030 | B1 * | 9/2002 | Meinke | 292/347 |
| 6,497,437 | B1 * | 12/2002 | Munch et al. | 292/336.3 |
| 6,543,090 | B2 * | 4/2003 | Muneta | 16/412 |
| 6,598,912 | B2 * | 7/2003 | Hillgaertner et al. | 292/225 |
| 6,709,033 | B2 * | 3/2004 | Jooss et al. | 292/336.3 |
| 6,740,834 | B2 * | 5/2004 | Sueyoshi et al. | 200/600 |
| 6,779,372 | B2 * | 8/2004 | Arlt et al. | 70/237 |
| 6,880,870 | B2 * | 4/2005 | Costigan | 292/336.3 |
| 6,883,840 | B2 * | 4/2005 | Sueyoshi et al. | 292/336.3 |
| 6,910,303 | B1 * | 6/2005 | Mathofer | 49/503 |
| 7,217,899 | B2 * | 5/2007 | Hidaka et al. | 200/600 |
| 2005/0012345 | A1 * | 1/2005 | Saitoh | 292/336.3 |
| 2006/0049647 | A1 * | 3/2006 | von zur Muehlen | 292/336.3 |
| 2009/0302620 | A1 * | 12/2009 | Muller et al. | 292/336.3 |
| 2010/0171327 | A1 * | 7/2010 | Muller et al. | 292/336.3 |

FOREIGN PATENT DOCUMENTS

| | | |
|---|---|---|
| DE | 10217488 | 11/2003 |
| DE | 102004044758 | 4/2006 |
| JP | 2000145213 | 5/2000 |
| JP | 2000192695 | 7/2000 |

* cited by examiner

DEVICE FOR ACTUATING THE CLOSURE OF A MOVABLE PART

TECHNICAL FIELD

The invention concerns a device for the activation of a lock of a movable part of a motor vehicle, particularly a door or tailgate or the like, with a support that is fixable on the inside of the movable part, a bearing unit that can swivel about a first axis provided on the support, and a handle that has a first and second handle end, wherein the second handle end is fixed on the bearing unit, whereby the handle swivels together with the bearing unit.

BACKGROUND

In DE 102 17 488 B4 a device is described with a support fixable from the inside of the door of the motor vehicle in the area of the external paneling of the door. The support has a bearing pin for taking in a bearing that is located in the bearing unit. Further, a handle is provided that is coupled with the bearing unit that can swivel about an axis by its first and second handle end. The bearing unit is realized as a pinion that extends over the whole length of the handle. Assembly of the handle on the pinion comes about by a sorting movement with two motion phases. First, the handle is moved vertically in the longitudinal direction of the pinion in an insertion phase. Then the handle is moved parallel to the longitudinal direction of the pinion in a shifting phase. The first handle end of the handle here consists of a jutting pin, which meshes into a counter-coupling part of the pinion, configured as a pin hole. Disadvantageously, the motion phases described in relation to assembly turn out to be costly.

BRIEF SUMMARY

The disclosure provides a device of the kind mentioned, in which the shortcomings just mentioned are avoided. In particular, a device will be provided by which the assembly costs of the handle can be kept minimal.

According to the invention, it is provided that the first handle end is placed so as to swivel directly on the first axis and, for a horizontal placement of the first handle end, at least one bearing element is provided, which is arranged in the area of the first axis.

In contrast to the stated prior art, the first handle end is arranged directly on the first axis on which the bearing unit lies for swiveling. The bearing unit is simplified in its construction in comparison with the prior art since the first handle end engages only on the first axis of the support. Therefore assembly is less costly. The bearing element ensures that an unwanted tipping mobility of the handle is ruled out. The bearing element causes the first handle end, particularly the handle, to be held in any position in the horizontal situation.

Unwanted abrasions can thus be effectively avoided with the activation of the handle. When the user activates the handle, the handle according to the invention swivels with the bearing unit around the shared first axis, wherein the first handle end, detached from the bearing unit, swivels around the first axis as well.

In an advantageous embodiment, the bearing unit has a first and a second bearing element, wherein the first handle end extends between the first and the second bearing element. The bearing elements can be formed as appendages of a kind that hold the first handle end horizontal to the first axis. Preferably, the bearing unit is formed with the bearing elements so that during activation of the handle the bearing unit is swiveled around the first axis with the two bearing elements, wherein the first handle end of the handle element maintains a horizontal bearing over the two bearing elements.

It is particularly advantageous that there is a loose fit between the first handle end and the bearing element. In a particular embodiment of the device according to the invention there is a null fit between the first handle end and the bearing element. Since the bearing unit and the handle move in parallel with the first handle end during the activation of the handle, relative movement between the two component parts is relatively nil, so that any abrasion between the first handle end and the bearing element or between the first and the second bearing element and the bearing unit can be effectively avoided.

One measure to improve the invention can provide that the first axis is formed by a pin on which the first handle end is positioned. The one end of the bearing unit preferably forms a closed bearing on the first axis. Functionally, the pin extends through bearing holes of the bearing unit, wherein the pin, which can be realized as a cylinder, is fixed at its free ends to the support. Preferably the first handle end is formed open on one end as an elongated hole, wherein the handle end covers the first axis at least sectionally. The assembly costs of the arrangement of the first handle end on the first axis are thereby simplified. Moreover, tolerances, which can arise with molding of the relevant components, such as handle, bearing unit, etc., or with temperature fluctuations, for example, are effectively balanced out at the first handle end via the aforementioned elongated hole, without additional abrasive spots arising.

In a further alternative of the invention, the bearing element is formed by a groove configured on the pin. The bearing element in this embodiment is located directly on the first axis, wherein the groove of the pin provides for a horizontal bearing of the first handle end.

It is particularly advantageous that an outgoing unit leading to the lock is provided on the bearing unit and/or the handle. The lock of the moving part of the motor vehicle is activated, especially opened, via the outgoing unit with the activation of the handle when the lock is in the unlocked position. The lock cylinder of the device according to the invention can also be connected with an additional outgoing unit, which acts on the lock when the lock cylinder is activated and locks or unlocks it. The outgoing unit can be realized as a Bowden cable, for example.

Alternatively, a coupling element, seated so as to rotate on a second rotational axis, can be provided, on which an outgoing unit leading to the lock engages, and the coupling element is in operative connection with the bearing unit. With the activation of the handle, the bearing unit simultaneously swivels about the first axis, wherein the bearing unit moves the coupling element, thereby moving the outgoing unit over the coupling element. Preferably, the bearing unit is able to swivel with the handle from a first position into a second position, and vice versa. The first position is the rest position. In the second position of the handle, an activation of the lock for opening the movable part is triggered, with the handle having been previously moved by a defined angle range out of the movable part around the first rotational axis. Preferably, the bearing unit contacts a first stop element in its first position. In the second position the bearing unit can touch a second stop element in the second position. The cited stop elements can be integrated on the fixed support, for example.

In a particular arrangement a spring element is provided, which is in operative connection with the coupling element and the bearing unit, wherein the spring element in the second position of the bearing unit exerts a restoring force such that the bearing unit can be moved separately into its first position. The coupling element can preferably be fashioned with an adapter in which the outgoing unit is held. At its one end, the outgoing unit can be fixed to the above-mentioned adapter coherently in form and/or strength and/or material.

In order that, with a side impact, activation of the lock as well as an opening of the movable part, particularly of the motor vehicle door, does not ensue, at least one mass balancing weight is integrated into the device according to the invention. A particularly compact construction is achieved when the mass balancing weight is integrated onto the coupling element.

It can further be provided that the device according to the invention is monitored by an electronic control system. For reasons of safety technology it can be advantageous for the positions of the handle or the coupling element to also be detected, in addition to the position of the bearing unit. This can be carried out by sensors, for example, particularly magnetic field sensors that include the magnetic field of a permanent magnet mounted on the coupling element, on the bearing unit or on the handle.

BRIEF DESCRIPTION OF THE DRAWINGS

Further advantages, features and details of the invention emerge from the following description, in which examples of embodiments of the invention are described in detail with reference to the figures. Therein the features mentioned in the claims and in the description either singly by themselves or in any combination are essential to the invention. They are:

DETAILED DESCRIPTION

Figure 1:
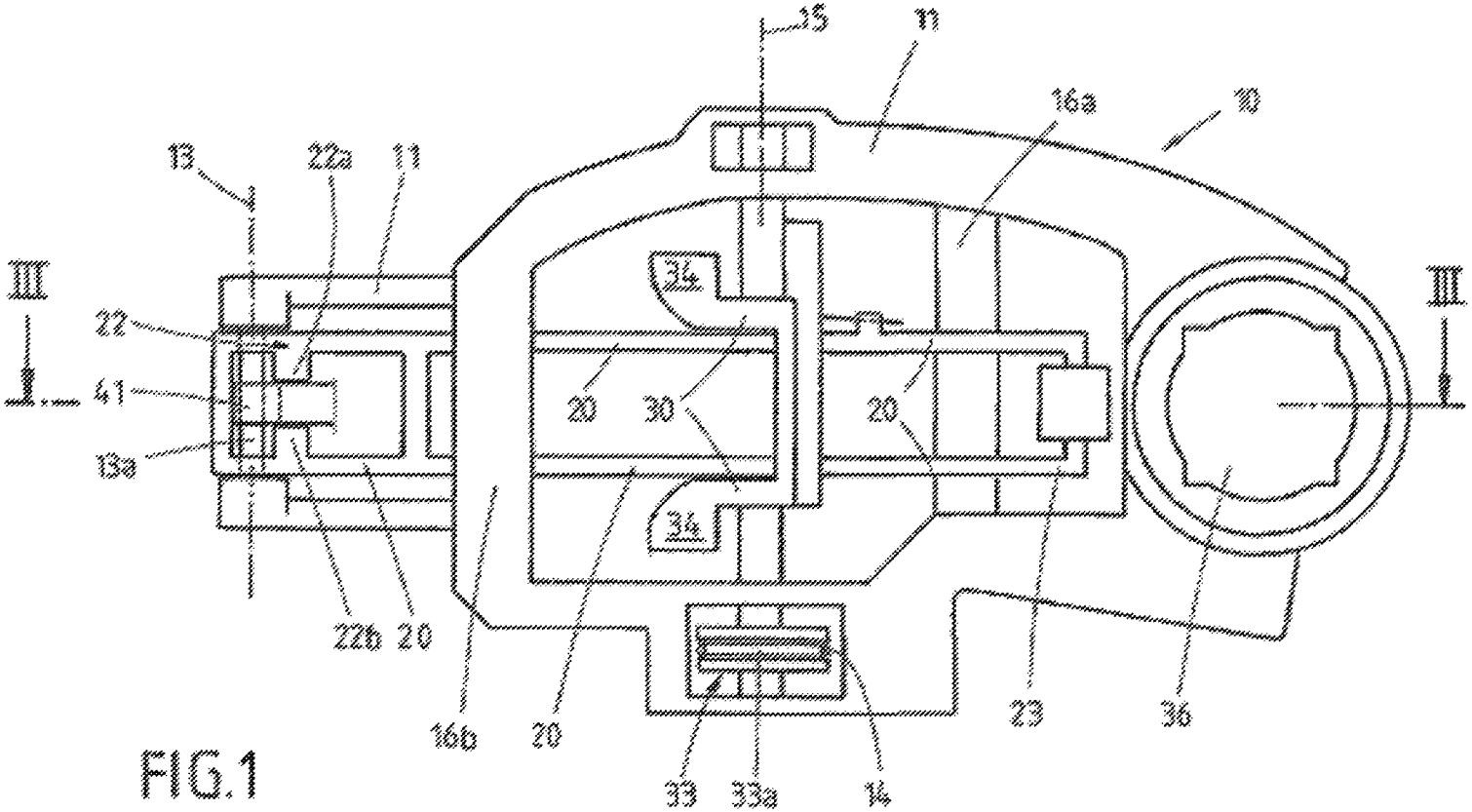
FIG. 1, a simplified representation of a device according to the invention for the activation of a lock of a motor vehicle door in a first position, FIG. 2, the device of the invention according to FIG. 2 in a second position, FIG. 3, a simplified sectional view along the intersect line III-III in FIG. 1, FIG. 4, a simplified sectional view along the intersect line IV-IV in FIG. 2 and FIG. 5, an alternative embodiment of the invention in an enlarged representation in the area of the first rotational axis.

In FIGS. 1 to 4 a device 10 according to invention for the activation of a lock of a motor vehicle door 12 is represented. The device 10 has a fixed support 11, which is fastened on the inside of the movable door 12. On the left region of the support 11 a first axis 13 is provided, on which a bearing unit 20 is arranged to swivel. The bearing unit 20 is realized as a kind of pinion. As FIGS. 3 and 4 make clear, the handle 40 has a first and a second handle end 41, 42, wherein the second handle end 42 is fastened on the free end 23 of the bearing unit 20.

The first handle end 41 is arranged to swivel on the first axis 13. In the present embodiment of the invention, in this connection, the first handle end 41 is formed open on one end as an elongated hole, wherein the first handle end 41 with its elongated hole covers the first axis 13 at least sectionally. As FIGS. 1 and 2 make clear, the first handle end 41 of the handle 40 is positioned directly on the first axis 13. In this connection, the first axis 13 is formed by a pin 13*a*, which is received inside the elongated hole of the first handle end 41. In order for the handle 40, especially the first handle end, to remain reliably in the horizontal position on the first axis 13, tongue-like bearing elements 22*a*, 22*b* are arranged on the movable bearing unit 20 and limit the first handle end 41 on two sides. These projection-like bearing elements 22*a*, 22*b* are provided on the bearing unit 20 in the area of the first axis 13. In this connection, the first and second bearing elements 22*a*, 22*b* are positioned to lie opposite each other at a defined distance. The empty space that is formed between the first and second bearing elements 22*a*, 22*b* is nearly filled by the first handle end 41. The first handle end 41 extends between the first and the second bearing elements 22*a*, 22*b* and is moveably arranged to swivel at the pin 13*a*.

Figure 2:
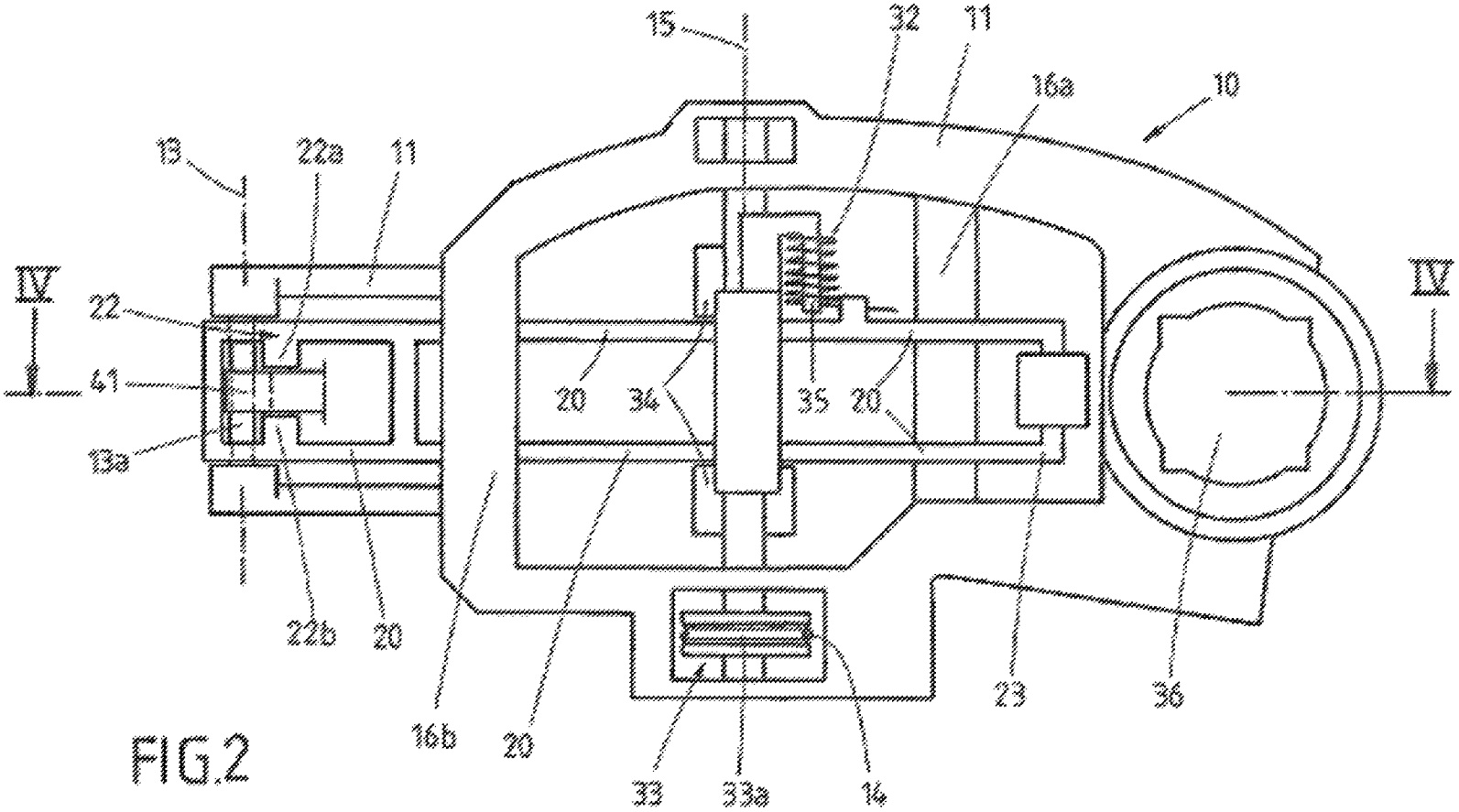
Figure 4:
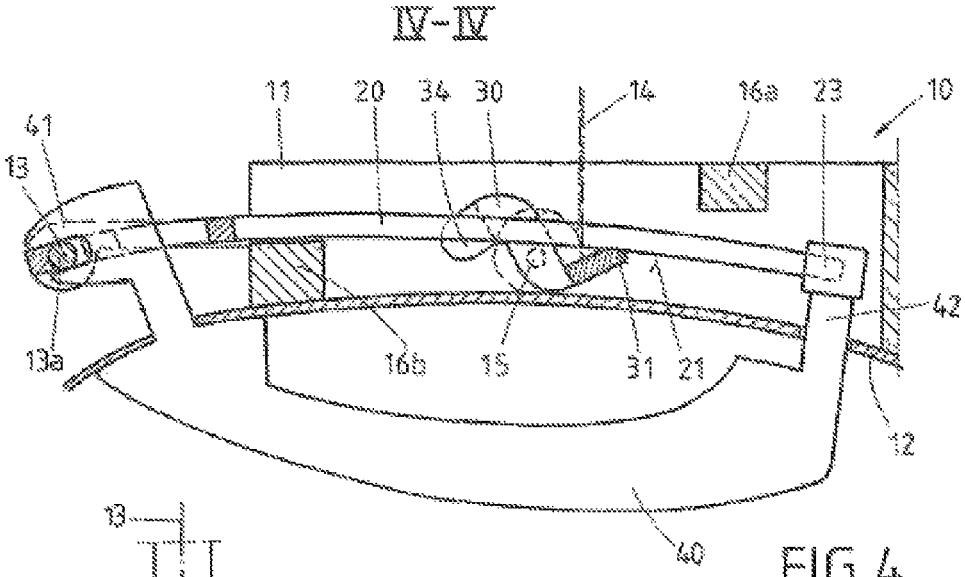

In the present embodiment there is a loose fit between the first handle end 41 and the first and second bearing elements 22*a*, 22*b*. If the user activates the handle 40, as indicated in FIGS. 2 and 4, the bearing unit 20 is swiveled around the first axis 13 across the second grip end 42. Since the bearing unit 20 and the handle 40 move in parallel, the relative motion in the area of the first axis 13 is very slight or almost "nil", so that there is almost no abrasion on the first and second bearing elements 22*a*, 22*b* by the first handle end 41 of the handle 40.

Further, in FIGS. 1 to 4 an outgoing unit 14 leading to the lock is represented. In the present embodiment the outgoing unit 14 is provided on a coupling element 30 that is set to turn on a further rotational axis 15, wherein the coupling element 30 is in operative connection with the bearing unit 20. In a further alternate embodiment (not represented) the outgoing unit 14 leading to the lock can be provided on the bearing unit 20 or on the handle 40 or even on the stationary support 11. As FIG. 2 shows, the bearing unit 20 has a flange face 21 that is turned toward the handle 40. Further, the coupling element 30 which swivels about the second rotational axis 15 is fashioned with a contact area 31 upon which the flange face 21 acts during the movement of the bearing unit 20.

Figure 3:
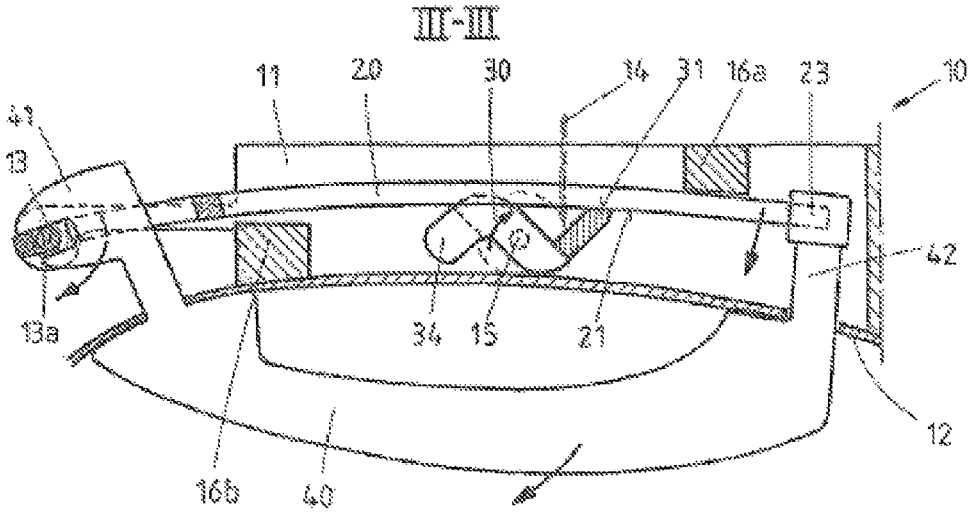

As FIGS. 3 and 4 make clear, the bearing unit 20 with the handle 40 is able to swivel from a first position (see FIG. 3) into a second position (see FIG. 4) and vice versa. The first position is the rest position. During the movement from the first position into the second position the outgoing unit 14 is activated, whereby a lock of the motor vehicle (not explicitly shown) can be opened if the lock is already in the unlocked position. The motor vehicle door 12 then opens. The outgoing unit 14 in the present embodiment is a Bowden cable, which extends up to the lock. The outgoing unit 14 is held on an adapter 33, which materially forms a shared component part with the coupling element 30, said part being movable around the second rotational axis 15. The roll-type adapter 33 is made with a groove 33*a*, in which the outgoing unit 14, especially the Bowden cable, is conducted and held. With the activation of the handle 40, bearing unit 20 swivels about the first rotational axis 13. At the same time the flange face 21 presses on the contact area 31 of the coupling element 30, whereby the coupling element 30 turns about the second rotational axis 15. During the movement of the bearing unit 20 the contact area 31 of the coupling element 30 rolls on the flange face 21. In the first position of the bearing unit 20 according to FIGS. 1 and 3, the contact area 31, which lies on the flange face 21 of the bearing unit 20, has a defined distance to the second rotational axis 15. While the coupling element 30 turns around the second rotational axis 15, the adapter 33 also moves in the same direction of rotation, wherein the Bowden cable 14 is wound onto the adapter 33 by a specific amount. This creates a tractive force on the outgoing unit 14, which acts directly on the lock.

As FIGS. 3 and 4 make clear, the support 11 is fastened with the swiveling bearing unit 20 on the door's inside 12. The handle 40 is first additionally fixed to the pinion 20 as well as to the first axis 13, from the door's outside 12. As FIG. 1 to FIG. 4 show, the support 11 has a first and a second stop element 16*a*, 16*b*. The bearing unit 20 lies on the first stop element 16*a* with its right area in its first position.

Further, the device according to the invention has a spring element 32 that is in an operative connection with the coupling element 30 and the bearing unit 20. In the second position of the bearing unit 20, the spring element 32 exerts a restoring force such that the bearing unit 20 moves separately into its first position according to FIG. 1. In the present embodiment the coupling element 30 has a pin 35 on which the spring element 32 is placed (see FIG. 2).

The coupling element 30 is further constructed with two mass balancing weights 34 that move along around the second rotational axis 15 during the movement of the bearing unit 20 from the first into the second position. These mass balancing weights 34 serve to keep the bearing unit 20 from being undesirably forced into its second position with any side impact from any occurring centrifugal forces, by which an unwanted opening of the door 12 would be triggered. In this case the mass balancing weights 34 act against effective centrifugal forces so that a movement of the bearing unit 20 around the first rotational axis 13 in the direction of the second position is out of the question.

Figure 5:
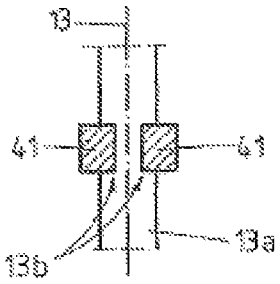

In FIG. 5 a further embodiment of the invention is represented, wherein the first handle end 41 is received inside the bearing element 22. The bearing element 22 is fashioned on the pin 13*a* that forms the first rotational axis 13. In place of the first and second bearing elements 22*a*, 22*b*, the first handle end 41 is held reliably by a groove 13*b* fashioned on the pin 13*a*, which is realized in FIG. 1 to FIG. 4 as an elongate hole. The remaining arrangement of the device 10 according to the invention corresponds essentially to the embodiment of FIG. 1 to FIG. 4. When the handle 40 is activated by the user, the first handle end 41 swivels about the first rotational axis 13, wherein the groove 13*b* holds the first handle end 41 in its horizontal position. In this second embodiment, as well, there is a loose fit between the pin 13*a* and the first handle end 41 located inside the groove 13*b*, so that during the activation of the handle 40 almost no abrasion occurs between the two above-mentioned components 13*a*, 41.

The support 11 is further implemented with an opening 36] in which a lock cylinder (not represented) is introduced into the support 11 and held there. The lock cylinder can also have an outgoing unit, which acts on the lock when the lock cylinder is activated and locks or unlocks it.

The invention claimed is:

1. A device for activation of a lock of a movable part of a motor vehicle, comprising:

a support that is fixable to an inside of the movable part, a bearing unit that can swivel about a first axis provided on the support, and a handle that has a first and a second handle end, wherein the second handle end is fixed on the bearing unit, whereby the handle swivels together with the bearing unit, wherein the first handle end is seated so as to swivel directly on the first axis and wherein the first axis is formed by a pin, the first handle end being positioned on the pin, wherein, for a horizontal placement of the first handle end at least one bearing element is provided, which is arranged in an area of the first axis, wherein the bearing unit has a first bearing element and a second bearing element, and wherein the first handle end extends between the first bearing element and the second bearing element, wherein there is a fit between the first handle end and the bearing element, wherein the bearing unit and the handle move in parallel with the first handle end during the activation of the handle, so that there is relative movement between the first handle end and the bearing element, wherein abrasion between the first handle end and the bearing element or between the first bearing element and the second bearing element and the bearing unit is avoided.

2. The device of claim 1, wherein the first handle end is formed open on one end as an elongated hole, and wherein the first handle end covers the first axis at least sectionally.

3. The device of claim 1, wherein the bearing element is formed by making a groove on the pin.

4. The device of claim 1, wherein an outgoing unit leading to the lock is provided on the bearing unit and/or handle.

5. The device of claim 1, wherein a coupling element seated so as to turn on a second rotational axis is provided, on which an outgoing unit leading to the lock engages, and the coupling element is in an operative connection with the bearing unit.

6. The device of claim 5, wherein the bearing unit with the handle is able to swivel from a first position into a second position and vice versa, wherein the bearing unit in the first position contacts a first stop element, and/or the bearing unit in the second position contacts a second stop element.

7. The device of claim 6, wherein the support further includes the first stop element and/or the second stop element.

8. The device of claim 1, wherein the second handle end is fastened on the side of the bearing unit that faces the first rotational axis.

9. The device of claim 6, wherein during the movement of the bearing unit from the first into the second position, the coupling element moves around the second rotational axis.

10. The device of claim 1, wherein the bearing unit is fashioned with a flange face that is turned toward the handle, and the coupling element has a contact area upon which the flange face acts during the movement of the bearing element.

11. The device of claim 10, wherein the contact area has a distance from the second rotational axis.

12. The device of claim 10, wherein during the movement of the bearing unit the contact area rolls on the flange face.

13. The device of claim 6, wherein a spring element is provided, which is in an operative connection with the coupling element and the bearing unit, wherein in the second position of the bearing unit the spring element exerts a restoring force such that the bearing unit is movable separately into its first position.

14. The device of claim 13, wherein the coupling element is fashioned with an adapter in which the outgoing unit is held.

15. The device of claim 13, wherein the coupling element has at least one mass balancing weight.

* * * * *